US008708056B2

(12) United States Patent
Helms et al.

(10) Patent No.: US 8,708,056 B2
(45) Date of Patent: Apr. 29, 2014

(54) EXTERNAL CASING PACKER AND METHOD OF PERFORMING CEMENTING JOB

(75) Inventors: Lonnie Helms, Duncan, OK (US); Frank Acosta, Duncan, OK (US); Nicholas Frederick Budler, Marlow, OK (US); John Key, Comanche, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 295 days.

(21) Appl. No.: 13/414,140

(22) Filed: Mar. 7, 2012

(65) Prior Publication Data

US 2013/0233572 A1 Sep. 12, 2013

(51) Int. Cl.
*E21B 33/13* (2006.01)

(52) U.S. Cl.
USPC ..... 166/387; 166/141; 166/373; 166/386; 166/332.1

(58) Field of Classification Search
USPC ..... 166/387, 141, 373, 386, 151, 332.1
See application file for complete search history.

(56) References Cited

U.S. PATENT DOCUMENTS

| | | | | |
|---|---|---|---|---|
| 4,436,151 | A * | 3/1984 | Callihan et al. | 166/154 |
| 5,048,611 | A * | 9/1991 | Cochran | 166/374 |
| 5,499,687 | A * | 3/1996 | Lee | 175/317 |
| 7,108,067 | B2 * | 9/2006 | Themig et al. | 166/317 |
| 2007/0151734 | A1 * | 7/2007 | Fehr et al. | 166/305.1 |
| 2008/0190620 | A1 * | 8/2008 | Posevina et al. | 166/332.1 |
| 2011/0056692 | A1 * | 3/2011 | Lopez de Cardenas et al. | 166/305.1 |

* cited by examiner

*Primary Examiner* — David Andrews
*Assistant Examiner* — Taras P Bemko
(74) *Attorney, Agent, or Firm* — McDermott Will & Emery LLP; John W. Wustenberg

(57) ABSTRACT

A packer that includes a mandrel, primary and secondary opening seats attached to an interior of the mandrel, a landing seat attached to the interior of the mandrel, a packer element attached to an exterior of the mandrel, and a closing seat attached to the interior of the mandrel. The secondary opening seat may be between the primary opening seat and the landing seat, and the primary opening seat may be between the closing seat and the secondary opening seat. The primary opening seat engages an opening plug and moves from a first position covering an opening to a second position not covering the opening, and the secondary opening seat engages the primary opening seat and moves from a first position covering a port to a second position not covering the port.

20 Claims, 8 Drawing Sheets

EXTERNAL CASING PACKER AND METHOD OF PERFORMING CEMENTING JOB

BACKGROUND

The present disclosure generally relates to multiple stage (or multiple stage zonal isolation) operations, and more particularly relates to packers and methods for performing cementing jobs.

During the drilling and construction of subterranean wells, casing strings are generally introduced into the wellbore. To stabilize the casing, a cement slurry is often pumped downwardly through the casing, and then upwardly into the annulus between the casing and the walls of the wellbore. One concern in this process is that, prior to the introduction of the cement slurry into the casing, the casing generally contains a drilling or some other servicing fluid that may contaminate the cement slurry. To prevent this contamination, a subterranean plug, often referred to as a cementing plug or a "bottom" plug, may be placed into the casing ahead of the cement slurry as a boundary between the two. The plug may perform other functions as well, such as wiping fluid from the inner surface of the casing as it travels through the casing, which may further reduce the risk of contamination.

Similarly, after the desired quantity of cement slurry is placed into the casing, a displacement fluid is commonly used to force the cement into the desired location. To prevent contamination of the cement slurry by the displacement fluid, a "top" cementing plug may be introduced at the interface between the cement slurry and the displacement fluid. This top plug also wipes cement slurry from the inner surfaces of the casing as the displacement fluid is pumped downwardly into the casing. Sometimes a third subterranean plug may be used, to perform functions such as preliminarily calibrating the internal volume of the casing to determine the amount of displacement fluid required, for example, or to separate a second fluid ahead of the cement slurry (e.g., where a preceding plug may separate a drilling mud from a cement spacer fluid, the third plug may be used to separate the cement spacer fluid from the cement slurry), for instance.

In some circumstances, a pipe string will be placed within the wellbore by a process comprising the attachment of the pipe string to a tool (often referred to as a "casing hanger and run-in tool" or a "work string") which may be manipulated within the wellbore to suspend the pipe string in a desired sub-surface location. In addition to the pipe string, a sub-surface release cementing plug system comprising a plurality of cementing plugs may also be attached to the casing hanger and run-in tool. Such cementing plugs may be selectively released from the run-in tool at desired times during the cementing process. Additionally, a check valve, typically called a float valve, will be installed near the bottom of the pipe string. The float valve may permit the flow of fluids through the bottom of the pipe string into the annulus, but not the reverse. A cementing plug will not pass through the float valve.

Conventional cementing plugs are formed with wiper fins on their exterior surface, which function to wipe the pipe string as they travel downhole. Conventional cementing plugs used to wipe large diameter casing strings are by their very nature expensive to make, both heavy and bulky to handle, and require additional time to drill out due to the sheer volume of drillable materials to be removed. Under some conditions it may be advantageous to the well operator to run casing strings consisting of two or more pipe sizes, with the larger pipe size being at the shallowest depth and progressively tapering to the minimum pipe size. These casing configurations are typically known as "tapered strings" and require specially designed cementing plugs to wipe the different pipe diameters involved. Conventional cementing plugs are thus, fairly complex devices that are relatively time-consuming and as a result, expensive to manufacture, difficult to use, and are more costly to drill out due to the increased plug length and/or material content.

In addition, cementing plugs may be required to pass through internal restrictions designed into special tools which may be incorporated into the pipe string, such as the seats in a plug operated multiple stage cementing device. The specially designed cementing plugs required to pass through these types of internal restrictions must both effectively wipe the casing internal diameter and pass through the internal restrictions with minimal pressure increase to avoid prematurely activating the tool. In these instances, it is generally impossible to place the special devices in tapered strings unless the device is located in the largest pipe size due to the increased pressure that would otherwise be required to force the mass of the larger wiper segments through the restrictions.

In conventional second stage operations, sleeves are individually shifted via plugs. Thus, in order to activate a number of sleeves, the same number of plugs are used in succession. However, it can be costly and time-consuming to drop a plug for each desired operation. Moreover, there is a marked increase in the complexity and, therefore, risk of running additional plugs. For example, incorrect plugs may be inadvertently used or operator error may occur in the release/launch of the proper plug at the appropriate time.

SUMMARY

The present disclosure generally relates to multiple stage (or multiple stage zonal isolation) operations, and more particularly relates to packers and methods for performing cementing jobs.

In some embodiments, the present disclosure provides a packer. The packer may include a mandrel, a primary opening seat attached to an interior of the mandrel, and a secondary opening seat attached to the interior of the mandrel. The packer may also include a landing seat attached to the interior of the mandrel, a packer element attached to an exterior of the mandrel, and a closing seat attached to the interior of the mandrel. The secondary opening seat may be arranged between the primary opening seat and the landing seat, and the primary opening seat may be arranged between the closing seat and the secondary opening seat. The primary opening seat may be configured to engage an opening plug and move from a first position where the primary opening seat covers an opening to a second position where the primary opening seat does not cover the opening. The secondary opening seat may be configured to engage the primary opening seat and move from a first position where the secondary opening seat covers a port to a second position where the secondary opening seat does not cover the port. The landing seat may be configured to engage the secondary opening seat and provide a seal, and the packer element may be configured to set when the port is not covered and the seal is provided. Lastly, the closing seat may be configured to engage a closing plug and move from a first position where the closing seat does not cover the opening to a second position where the closing seat covers the opening.

In some aspects of the disclosure, a method is disclosed. The method may include providing a packer, where the packer includes a mandrel, a primary opening seat attached to an interior of the mandrel, a secondary opening seat attached to the interior of the mandrel, a landing seat attached to the interior of the mandrel, a packer element attached to an exterior of the mandrel, and a closing seat attached to the interior of the mandrel. The secondary opening seat may be between the primary opening seat and the landing seat, and the primary opening seat may be between the closing seat and the secondary opening seat. The primary opening seat may be configured to engage an opening plug and move from a first position where the primary opening seat covers an opening to a second position where the primary opening seat does not cover the opening, and the secondary opening seat may be configured to engage the primary opening seat and move from a first position where the secondary opening seat covers a port to a second position where the secondary opening seat does not cover the port. The landing seat may be configured to engage the secondary opening seat and provide a seal, the packer element may be configured to set when the port is not covered and the seal is provided, and the closing seat may be configured to engage a closing plug and move from a first position where the closing seat does not cover the opening to a second position. In some embodiments, the closing seat covers the opening. The method may also include providing the opening plug, providing the closing plug, and placing the opening plug into the packer. The method may further include placing the closing plug into the packer. In at least one embodiment, placing the opening plug into the packer may precede placing the closing plug into the packer.

In some aspects of the disclosure, another method is disclosed. The method may include providing a packer that includes a mandrel, a primary opening seat attached to an interior of the mandrel, a secondary opening seat attached to the interior of the mandrel, a landing seat attached to the interior of the mandrel, a packer element attached to an exterior of the mandrel, and a closing seat attached to the interior of the mandrel. The secondary opening seat may be between the primary opening seat and the landing seat, and the primary opening seat may be between the closing seat and the secondary opening seat. The primary opening seat may be configured to engage an opening plug and move from a first position where the primary opening seat covers an opening to a second position where the primary opening seat does not cover the opening, and the secondary opening seat may be configured to engage the primary opening seat and move from a first position where the secondary opening seat covers a port to a second position where the secondary opening seat does not cover the port. The landing seat may be configured to engage the secondary opening seat and provide a seal, the packer element may be configured to set when the port is not covered and the seal is provided, and the closing seat may be configured to engage a closing plug and move from a first position where the closing seat does not cover the opening to a second position. In some embodiments, the closing seat covers the opening. The method may also include providing the opening plug, providing the closing plug, placing the opening plug into the packer, and placing the closing plug into the packer. In at least one embodiment, placing the opening plug into the packer may precede placing the closing plug into the packer.

The features and advantages of the present disclosure will be readily apparent to those skilled in the art upon a reading of the description of the preferred embodiments that follows.

BRIEF DESCRIPTION OF THE DRAWINGS

The following figures are included to illustrate certain aspects of the present disclosure, and should not be viewed as exclusive embodiments. The subject matter disclosed is capable of considerable modification, alteration, and equivalents in form and function, as will occur to those skilled in the art and having the benefit of this disclosure.

DETAILED DESCRIPTION

The present disclosure generally relates to multiple stage (or multiple stage zonal isolation) operations, and more particularly relates to packers and methods for performing cementing jobs.

Figure 1:
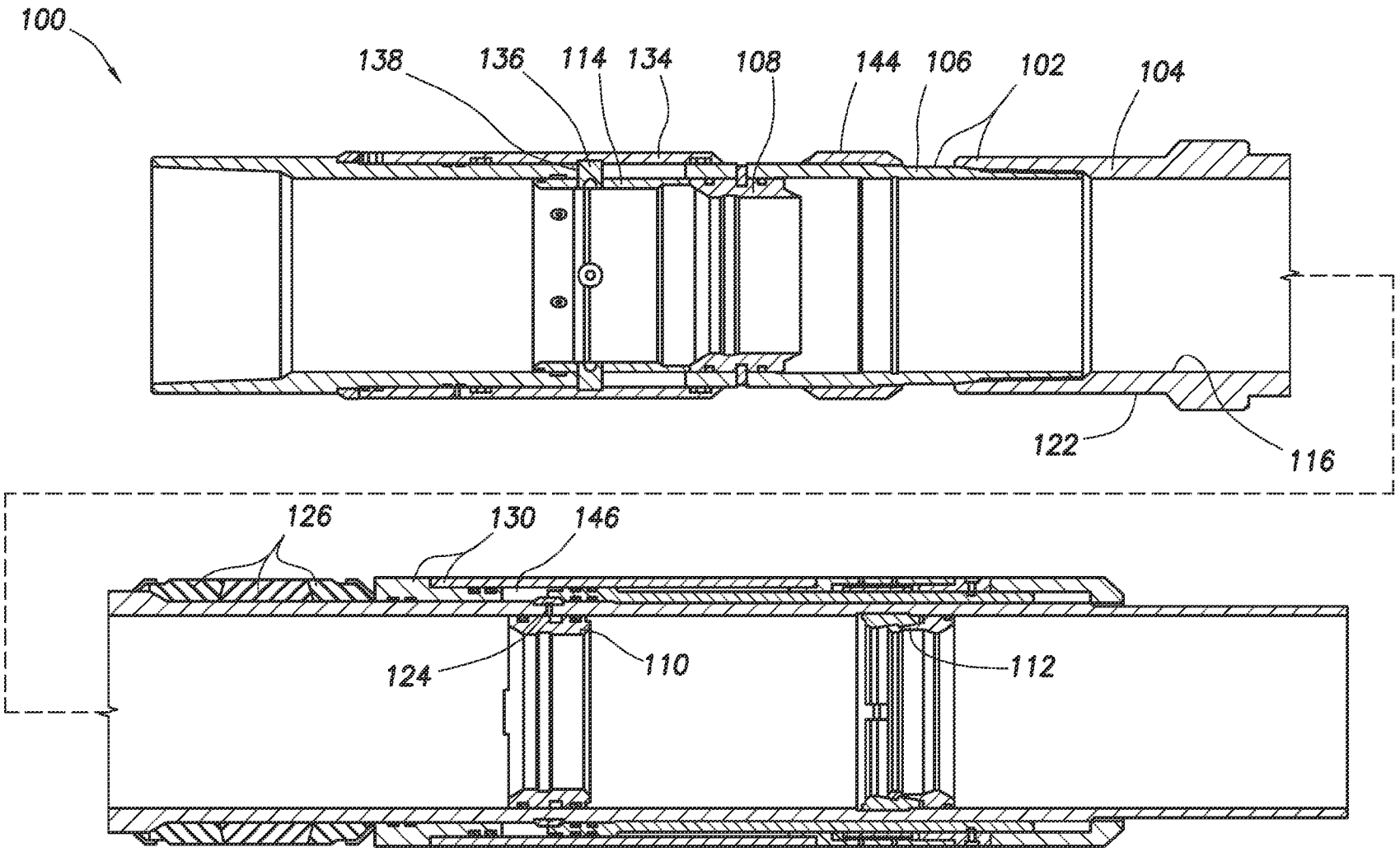
FIG. 1 illustrates a cross-sectional view of a packer in a run-in position, in accordance with one embodiment of the present disclosure.

Referring now to the figures, a packer 100 may be used for performing a cementing or other second stage operation in a multi-stage operation. The packer 100 may be an annular casing packer as illustrated in FIG. 1. The packer 100 may include a mandrel 102. The mandrel 102 may be a generally tubular element constructed of steel, aluminum, composite, or other materials used in oilfield operations. The mandrel 102 may include a packer mandrel 104 threadedly or otherwise connected to a multiple stage cementer mandrel 106.

A primary opening seat 108, a secondary opening seat 110, a landing seat 112, and a closing seat 114 may be attached to an interior 116 of the mandrel 102. Such attachment may be via shear pins, or other connections allowing selective movement of the respective elements relative to the mandrel 102. Movement of the primary opening seat 108 may uncover an opening 118 (shown in FIGS. 3-6) which may include a rupture disk 120 to provide selective communication between the interior 116 and an exterior 122 of the mandrel 102. Movement of the secondary opening seat 110 may uncover a port 124, allowing for actuation of a packer element 126 attached to the exterior 122 of the mandrel 102. Movement of the closing seat 114 may cover the opening 118 preventing communication between the interior 116 and the exterior 122 of the mandrel 102.

The primary opening seat 108 may be constructed of aluminum, composite, phenolics, or other materials used in zonal isolation operations. The primary opening seat 108 may be disposed between the closing seat 114 and the secondary opening seat 110. In a first position (e.g., a run-in position), the primary opening seat 108 may cover an opening 118 in the mandrel 102. Thus, fluid communication between the interior 116 and the exterior 122 of the mandrel 102 is prevented through the opening 118 when the primary opening seat 108 is in the first position. The primary opening seat 108 may have a first end with an interior surface having a conical or other shape suitable for swallowing, seating, or otherwise engaging an opening plug 128 (shown in FIGS. 2-8). The primary opening seat 108 may have a second end with an exterior surface having a pointed or other shape suitable for landing or seating in the secondary opening seat 110. When the opening plug 128 lands in the primary opening seat 108, the primary opening seat 108 may move from the first position to a second position. In the second position, the primary opening seat 108 may no longer cover the opening 118.

The opening plug 128 may be a plug, ball, dart, or other device for shifting and carrying a seat downward. The opening plug 128 may be formed of aluminum, composite, rubber, or other materials used in multiple stage zonal isolation operations. The opening plug 128 may have a leading edge or nose that is shaped to engage the primary opening seat 108.

The secondary opening seat 110 may be constructed of aluminum, composite, phenolics, or other materials used in multiple stage zonal isolation operations. The secondary opening seat 110 may be disposed between the primary opening seat 108 and the landing seat 112. In a first position, the secondary opening seat 110 may cover a port 124 in the mandrel 102. Thus, fluid communication between the interior 116 and the exterior 122 of the mandrel 102 is prevented when the secondary opening seat 110 is in the first position. The secondary opening seat 110 may have a first end with an interior surface having a conical or other shape suitable for swallowing, seating, or otherwise engaging the primary opening seat 108. The secondary opening seat 110 may have a second end with an exterior surface having a pointed or other shape suitable for landing or seating in the landing seat 112. When the primary opening seat 108 lands in the secondary opening seat 110, the secondary opening seat 110 may move from the first position to a second position. In the second position, the secondary opening seat 110 may no longer cover the port 124.

Figure 8:
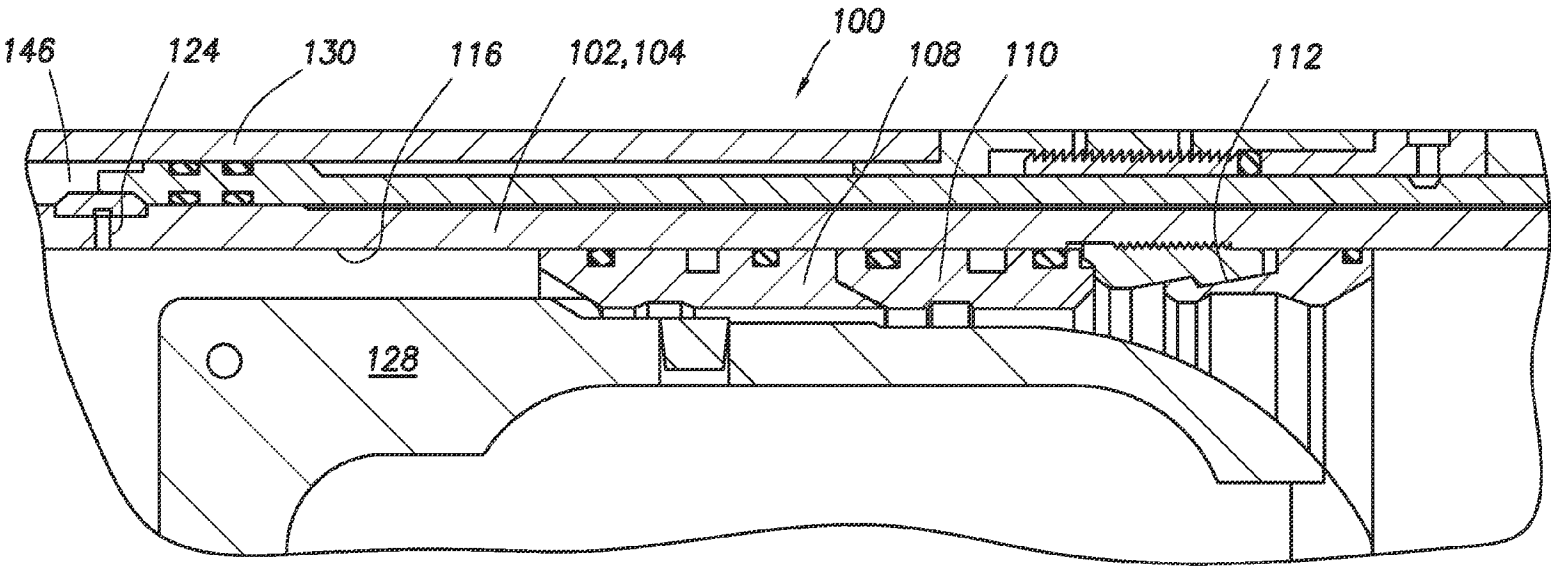
FIG. 8 illustrates a partial cross-sectional view of the landing seat of FIG. 4, in accordance with one embodiment of the present disclosure.

The landing seat 112 may be constructed of aluminum, composite, phenolics, or other materials used in multiple stage zonal isolation operations. As illustrated in FIG. 8, the landing seat 112 may include a pair of high-strength rings. The landing seat 112 may have a first end with an interior surface having a conical or other shape suitable for swallowing, seating, or otherwise engaging the secondary opening seat 110 and providing a seal. Such seal may substantially prevent flow through the interior 116 of the mandrel 102 past the landing seat 112. Thus, pressure may be increased within the mandrel 102, allowing the packer element 126 to set and/or the rupture disk 120 to burst.

At least one packer element 126 may be attached to the exterior 122 of the mandrel 102. However, any number of packer elements 126 may be used. As illustrated, three packer elements 126 may be attached to the exterior 122 of the mandrel 102. The packer element 126 may be a multi-duro or other packing element. The packer element 126 may communicate with a packer sleeve 130 which may move along the mandrel 102 and cause longitudinal compression of the packer element 126. Such longitudinal compression may cause radial expansion, allowing the packer element 126 to engage an interior surface of the wellbore. Other designs may be used for the packing mechanism, including, but not limited to, an Active Heave Compensator (AHC) packer and other annular casing packer variations. As illustrated in FIG. 8, the packer 100 may include a latching mechanism to maintain the packer element 126 in a set position.

The closing seat 114 may be constructed of aluminum composite, phenolics, or other materials used in second stage operations. In a first position (e.g., a run-in position), the closing seat 114 may not cover the opening 118 in the mandrel 102. Thus, fluid communication between the interior 116 and the exterior 122 of the mandrel 102 is permitted through the opening 118 when the closing seat 114 is in the first position. The closing seat 114 may have a first end with an interior surface having a conical or other shape suitable for swallowing, seating, or otherwise engaging a closing plug 132 (shown in FIGS. 6, 7, and 9). When the closing plug 132 lands in the closing seat 114, the closing seat 114 may move from the first position to a second position. In the second position, the closing seat 114 may cover the opening 118.

Figure 9:
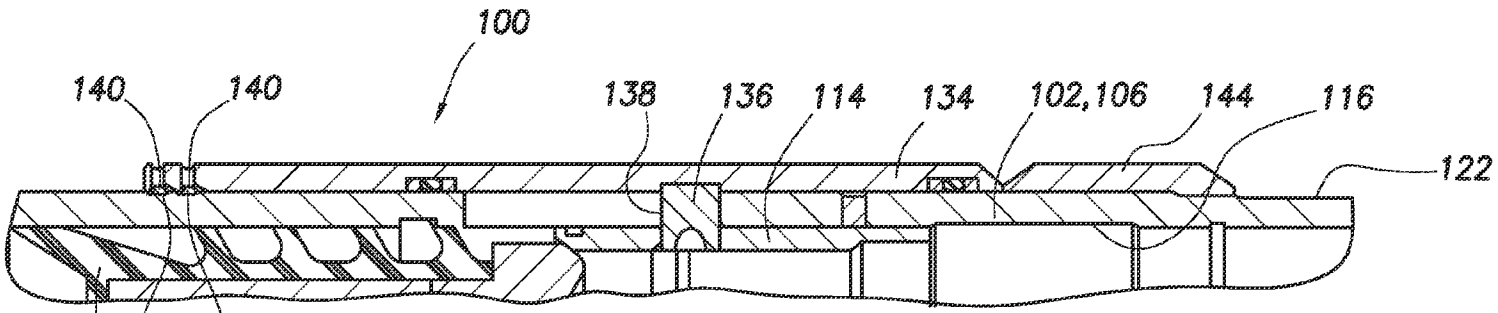
FIG. 9 illustrates a partial cross-sectional view of the closing sleeve of FIG. 7, in accordance with one embodiment of the present disclosure.

The closing seat 114 may engage a closing sleeve 134 exterior to the mandrel 102. A lug 136 may be provided between and connect the closing seat 114 and the closing sleeve 134 such that movement of the closing seat 114 results in similar movement of the closing sleeve 134. The lug 136 may lie at least partially in an opening or slot 138 in the mandrel 102. The closing sleeve 134 may be configured to prevent movement of the closing seat 114 beyond the second position. Thus, the closing sleeve 134 and the mandrel 102 may include a lock ring 140 and groove 142 or other configuration to prevent movement past a preset stop point. As illustrated in FIG. 9, multiple lock rings 140 and grooves 142 may be used in a similar manner.

The closing plug 132 may be a plug, ball, dart, or other device for shifting and carrying a seat downward. The closing plug 132 may be formed of aluminum, composite, rubber, or other materials used in multiple stage zonal isolation operations. The closing plug 132 may have a leading edge or nose that is shaped to engage the closing seat 114.

Figure 2:
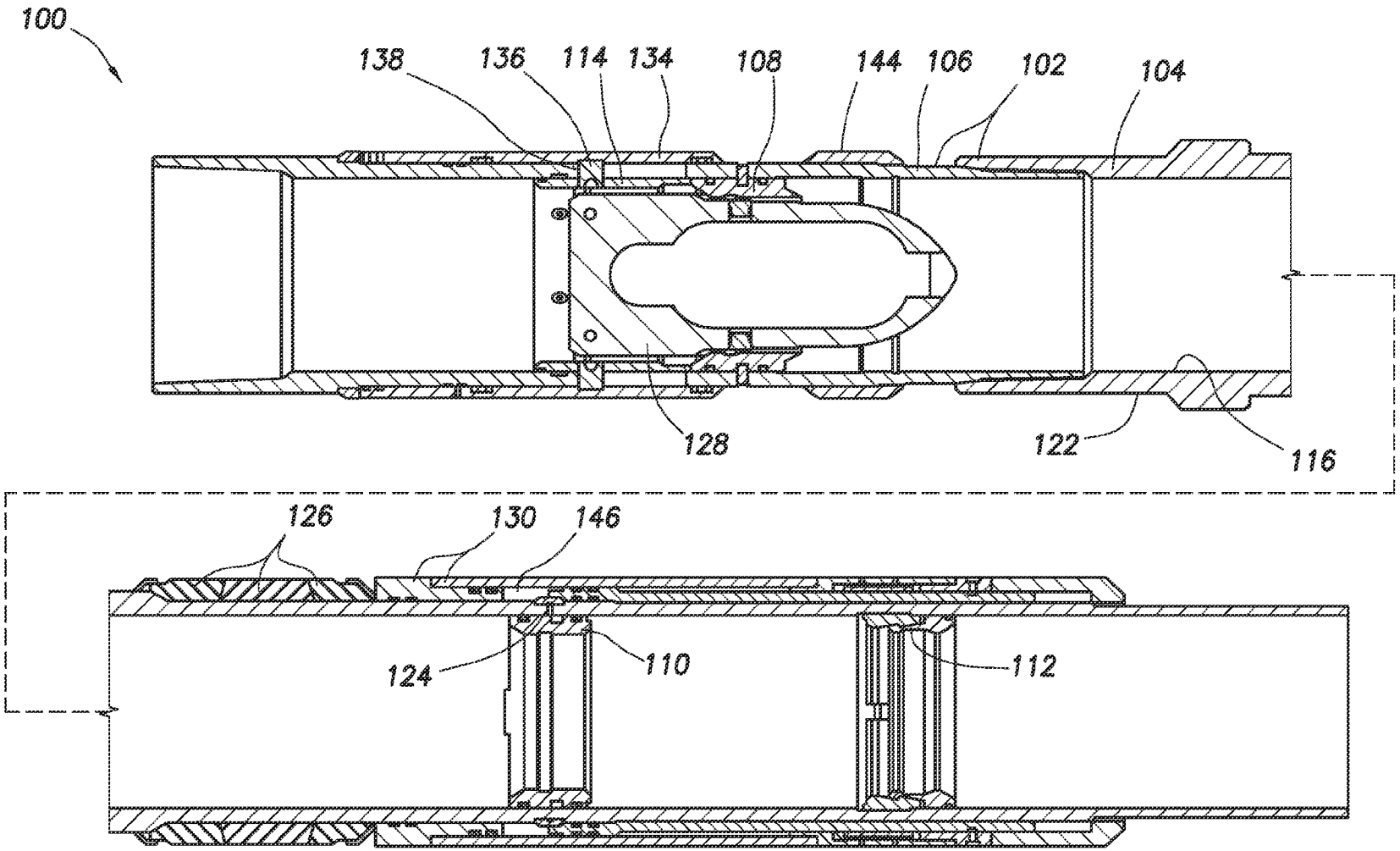
FIG. 2 illustrates a cross-sectional view of the packer of FIG. 1, with an opening plug on a primary opening seat, in accordance with one embodiment of the present disclosure.

A method of using the packer 100 may involve providing the packer 100 as described above, running the packer into a wellbore, providing the opening plug 128, placing the opening plug 128 into the packer 100, providing the closing plug 132, and placing the closing plug 132 into the packer 100. The packer 100 may be run into the wellbore as part of a casing string with each of the primary opening seat 108, the secondary opening seat 110, and the closing seat 114 in a first position, as illustrated in FIG. 1. Thus, the opening 118 may be covered by the primary opening seat 108 but not by the closing seat 114, and the port 124 may be covered by the secondary opening seat 110. Once the packer 100 is in the desired location in the wellbore, the opening plug 128 may be dropped into the casing string, and run in until it reaches the packer 100 and lands on the primary opening seat 108, as illustrated in FIG. 2. Moving the opening plug 128 into engagement with the primary opening seat 108 may require application of pressure on an interior of the casing string, which may be in communication with the interior 116 of the mandrel 102 of the packer 100.

Figure 3:
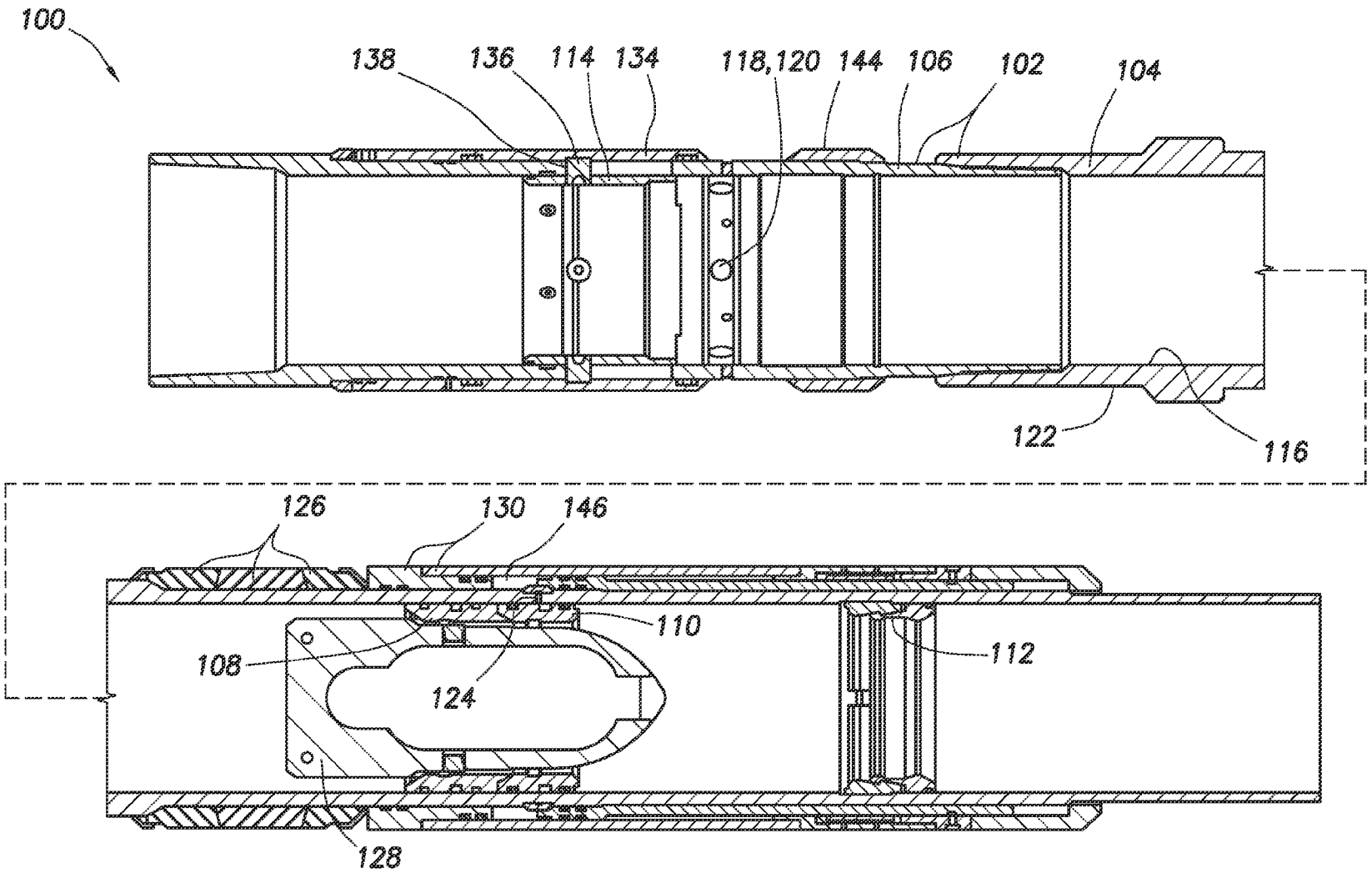
FIG. 3 illustrates a cross-sectional view of the packer of FIGS. 1 and 2, with the opening plug and primary opening seat moved onto a secondary opening seat, and an opening exposed, in accordance with one embodiment of the present disclosure.

Once the opening plug 128 has landed on the primary opening seat 108, pressure sufficient to cause the primary opening seat 108 to move from the first position to the second position may be applied. This pressure may be sufficient to shear a set of shear pins holding the primary opening seat 108 in engagement with the interior 116 of the mandrel 102, allowing the primary opening seat 108 and the opening plug 128 to move downward and land on the secondary opening seat 110, as illustrated in FIG. 3. As the primary opening seat 108 moves downward, the opening 118 may be uncovered, exposing the interior 116 of the packer 100 to the rupture disk 120. Thus, the opening plug 128 can be used to shift two different internal sleeves, providing access to the opening 118 for the second stage as well as allowing the packer element 126 to be set.

Figure 4:
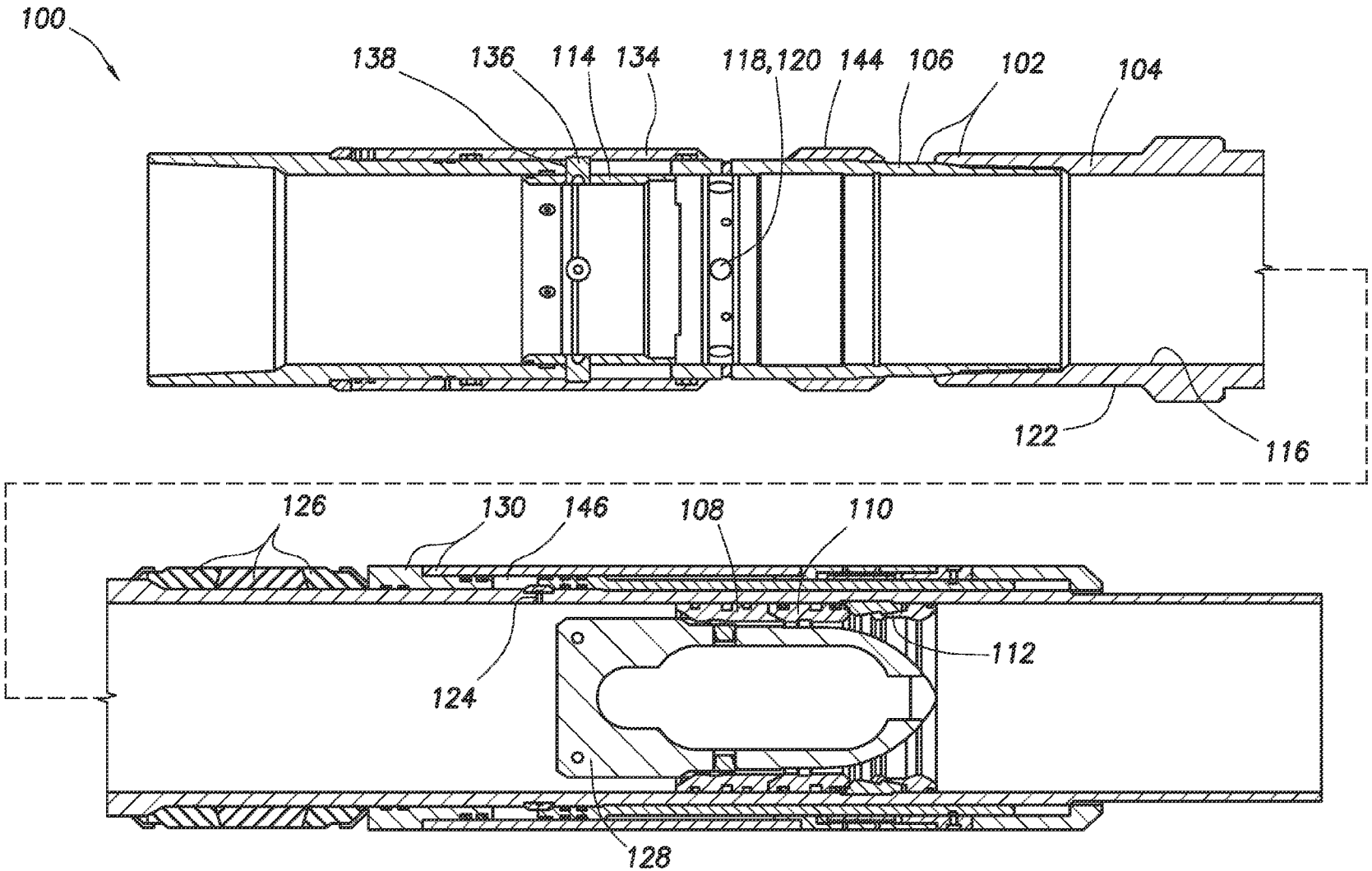
FIG. 4 illustrates a cross-sectional view of the packer of FIGS. 1-3, with the opening plug, primary opening seat, and secondary opening seat moved onto a landing seat, and a port exposed, in accordance with one embodiment of the present disclosure.

Once the primary opening seat 108 has landed on the secondary opening seat 110, pressure sufficient to cause the secondary opening seat 110 to move from the first position to a second position may be applied. This pressure may be sufficient to shear a set of shear pins holding the secondary opening seat 110 in engagement with the interior 116 of the mandrel 102, allowing the secondary opening seat 110 and the primary opening seat 108 and opening plug 128 to move downward and land on the landing seat 112, forming a seal, as illustrated in FIG. 4. As the secondary opening seat 110 moves downward, the port 124 will be uncovered, exposing the interior 116 of the packer 100 to the port 124.

Figure 5:
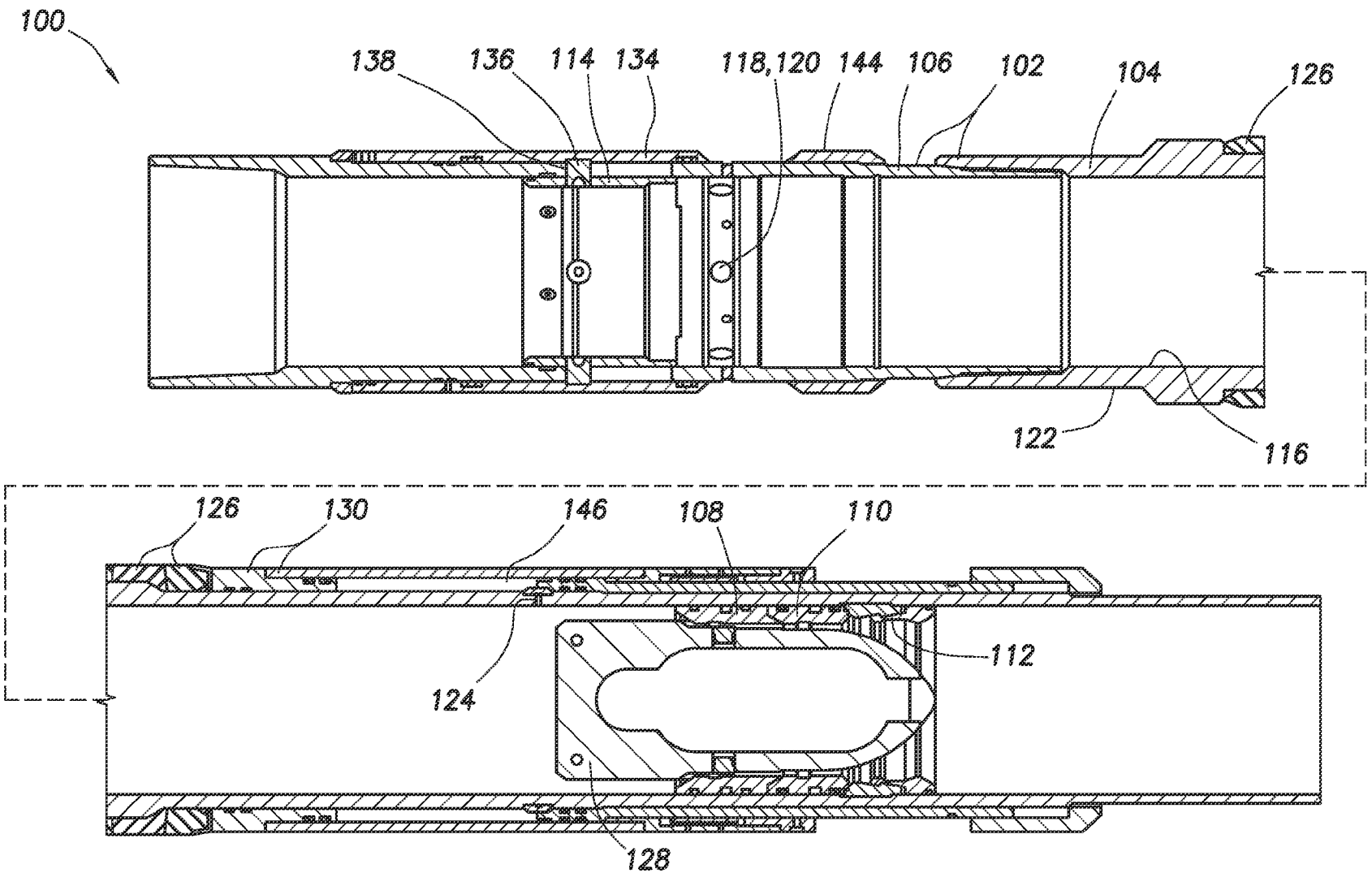
FIG. 5 illustrates a cross-sectional view of the packer of FIGS. 1-4, with packer elements set, in accordance with one embodiment of the present disclosure.

Once the port 124 is uncovered, fluid (e.g., internal casing fluid) may be free to flow from the interior 116 of the mandrel 102 of the packer 100 into a cavity 146 formed between the interior 116 and the exterior 122 of the packer 100, as illustrated in FIG. 8. Pressure differential between the interior 116 and the exterior 122 of the packer 100 may cause the packer sleeve 130 to move relative to the mandrel 102, compressing the packer element 126 in a longitudinal direction, thus radially expanding and setting the packer element 126, as illustrated in FIG. 5.

Uniform pressure may be provided to land the opening plug 128 on the primary opening seat 108 and move the primary opening seat 108 from the first position to the second position thereby uncovering the opening 118, land the primary opening seat 108 on the secondary opening seat 110 and move the secondary opening seat 110 from the first position to the second position thereby uncovering the port 124, and set the packer element 126. Alternatively, various pressures may be used for various actions.

Once the packer element 126 is set, additional pressure will be supplied to burst the rupture disk 120 covering the opening 118. The rupture disk 120 may be configured to burst at a predetermined pressure differential between the interior 116 of the mandrel 102 and the exterior 122 of the mandrel 102. The predetermined set point of the rupture disk 120 is generally higher than a shear set point for the movement of the secondary opening seat 110, such that the packer element 126 sets before the rupture disk 120 bursts. Once the rupture disk 120 has been breached, fluid may be introduced to flow through the opening 118. Such fluid may include cement or other material intended to be placed between the wellbore and the casing string, above the location of the packer 100.

Figure 6:
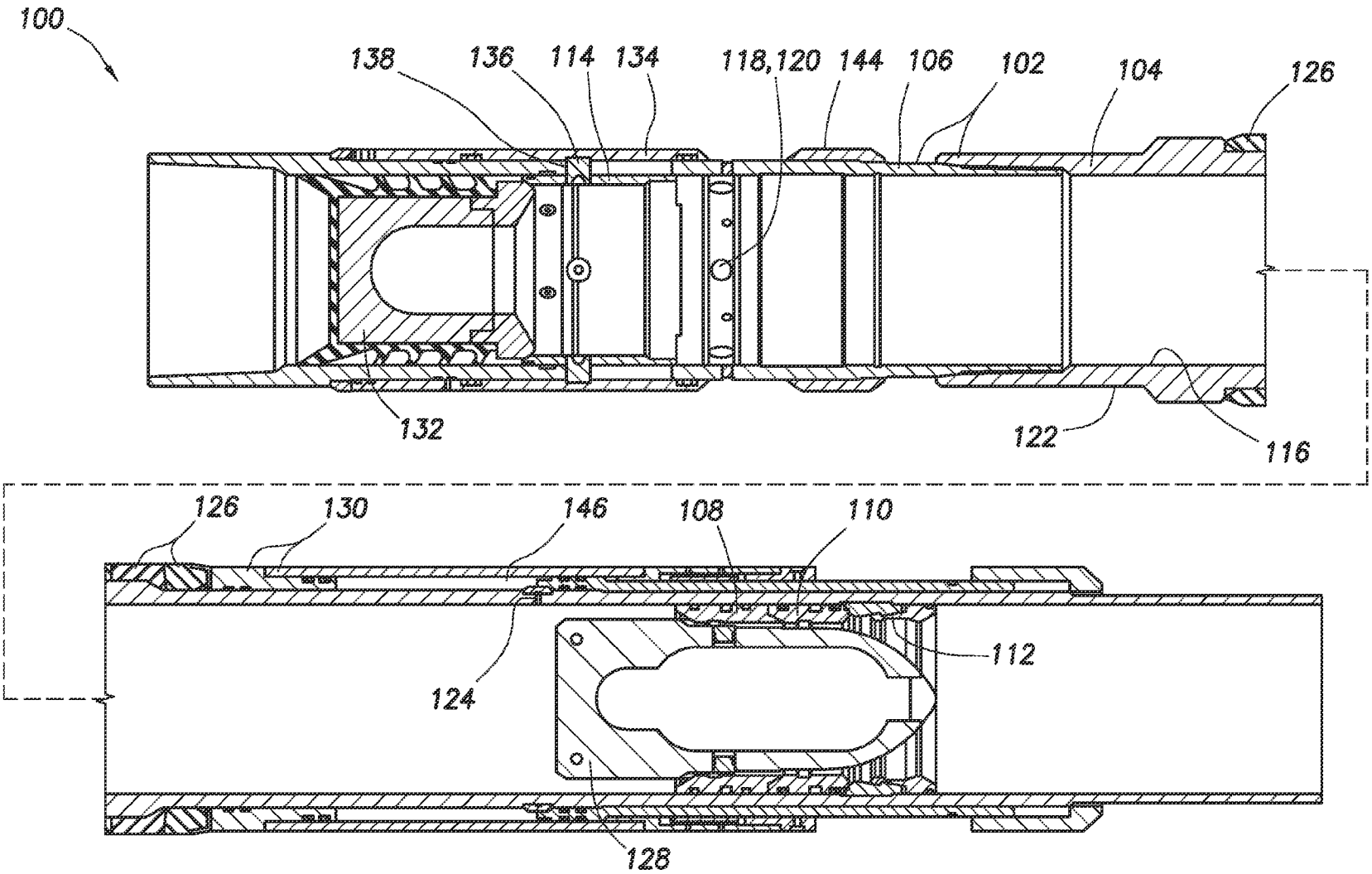
FIG. 6 illustrates a cross-sectional view of the packer of FIGS. 1-5, with a closing plug on a closing sleeve, in accordance with one embodiment of the present disclosure.

Once the fluid has been placed between the wellbore and the casing string, the opening 118 may be closed or covered through use of the closing plug 132. The closing plug 132 may be dropped into the casing string and pressure applied to cause the closing plug 132 to land on the closing seat 114, as illustrated in FIG. 6.

Figure 7:
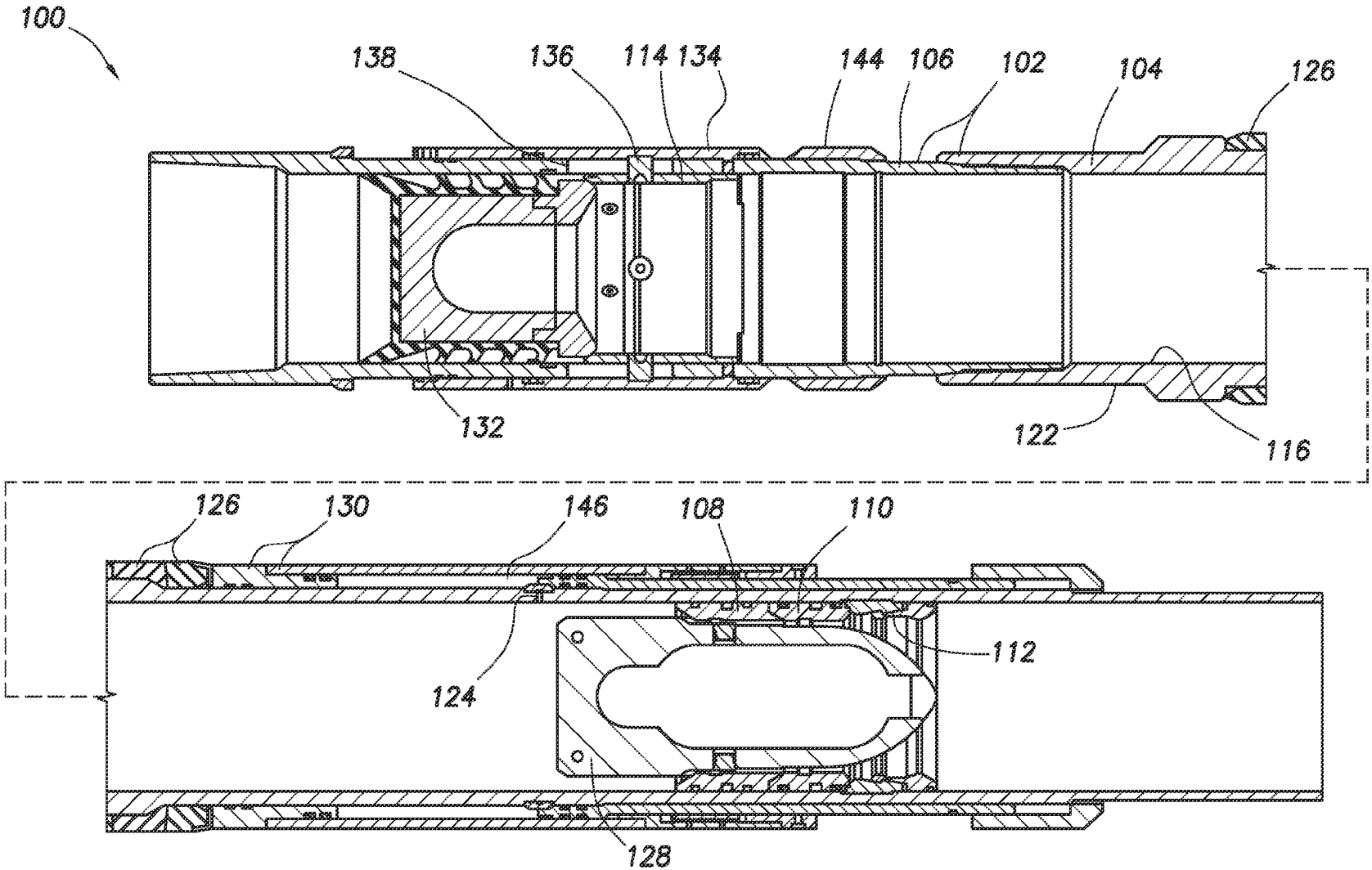
FIG. 7 illustrates a cross-sectional view of the packer of FIGS. 1-6, with a closing sleeve moved downward, covering the opening, in accordance with one embodiment of the present disclosure.

Once the closing plug 132 has landed on the closing seat 114, pressure sufficient to cause the closing seat 114 to move from the first position to a second position may be applied. This pressure may be sufficient to shear a set of shear pins holding the closing seat 114 in engagement with the interior 116 of the mandrel 102, allowing the closing seat 114 and the closing plug 132 to move downward until secured in position, as illustrated in FIG. 7. As the closing seat 114 moves downward, the opening 118 may be covered, preventing further flow therethrough. The closing plug 132 may be secured in position via lock rings 140 and corresponding grooves 142, as illustrated in FIG. 9. Thus, as the closing sleeve 134 moves downward, as a result of downward movement of the closing seat 114 and the lug 136, the closing sleeve 134 covers the slot 138 in the mandrel 102, and the opening 118, preventing flow from the interior 116 to the exterior 122 of the mandrel 102, and vice versa. The lock rings 140 may engage the grooves 142, preventing movement in the reverse direction, while an end of the closing sleeve 134 may engage the lower shoe 144 preventing further movement in the downward direction.

Once the secondary operations are complete, the opening plug 128 and the closing plug 132 may be drilled out. The drilling may also remove the primary opening seat 108, the secondary opening seat 110, the landing seat 112, and/or the closing seat 114.

As used herein, the term "downward" is used to describe distance into the wellbore, regardless of horizontal, inverted, or other orientation of the wellbore.

While the description above relates to a cementing apparatus, the designs described herein may also be used in many other tool designs where two plugs are used to actuate two tools or two processes.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present invention. The invention illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

The invention claimed is:

1. A packer comprising:

a mandrel;

a primary opening seat attached to an interior of the mandrel;

a secondary opening seat attached to the interior of the mandrel;

a landing seat attached to the interior of the mandrel;

a packer element attached to an exterior of the mandrel; and a closing seat attached to the interior of the mandrel;

wherein the secondary opening seat is between the primary opening seat and the landing seat;

wherein the primary opening seat is between the closing seat and the secondary opening seat;

wherein the primary opening seat is configured to engage an opening plug and move from a first position where the primary opening seat covers an opening to a second position where the primary opening seat does not cover the opening;

wherein the secondary opening seat is configured to engage the primary opening seat and move from a first position where the secondary opening seat covers a port to a second position where the secondary opening seat does not cover the port;

wherein the landing seat is configured to engage the secondary opening seat and provide a seal;

wherein the packer element is configured to set when the port is not covered and the seal is provided; and wherein the closing seat is configured to engage a closing plug and move from a first position where the closing seat does not cover the opening to a second position where the closing seat covers the opening.

2. The packer of claim 1, wherein the mandrel comprises a packer mandrel connected to a multiple stage cementer mandrel.

3. The packer of claim 1, comprising one or more packer elements.

4. The packer of claim 1, comprising a closing sleeve external to the mandrel and configured to engage the closing seat, wherein the closing sleeve prevents movement of the closing seat beyond the second position.

5. The packer of claim 4, wherein the mandrel comprises a slot, allowing a lug to connect the closing sleeve to the closing seat and wherein the packer comprises a lock ring to prevent the movement of the closing seat beyond the second position.

6. The packer of claim 1, comprising a lower shoe.

7. The packer of claim 1, wherein the opening comprises a rupture disk configured to burst at a predetermined pressure differential between the interior of the mandrel and the exterior of the mandrel.

8. A method comprising:

providing a packer comprising:

a mandrel, a primary opening seat attached to an interior of the mandrel, a secondary opening seat attached to the interior of the mandrel, a landing seat attached to the interior of the mandrel, a packer element attached to an exterior of the mandrel, and a closing seat attached to the interior of the mandrel, wherein the secondary opening seat is between the primary opening seat and the landing seat, wherein the primary opening seat is between the closing seat and the secondary opening seat, wherein the primary opening seat is configured to engage an opening plug and move from a first position where the primary opening seat covers an opening to a second position where the primary opening seat does not cover the opening, wherein the secondary opening seat is configured to engage the primary opening seat and move from a first position where the secondary opening seat covers a port to a second position where the secondary opening seat does not cover the port, wherein the landing seat is configured to engage the secondary opening seat and provide a seal, wherein the packer element is configured to set when the port is not covered and the seal is provided, and wherein the closing seat is configured to engage a closing plug and move from a first position where the closing seat does not cover the opening to a second position;

where the closing seat covers the opening;

providing the opening plug;

providing the closing plug;

placing the opening plug into the packer; and placing the closing plug into the packer;

wherein placing the opening plug into the packer precedes placing the closing plug into the packer.

9. The method of claim 8, wherein placing the opening plug into the packer comprises dropping the opening plug and supplying pressure sufficient to cause the opening plug to land on the primary opening seat.

10. The method of claim 8, further comprising uncovering the opening by supplying pressure sufficient to cause the primary opening seat to move from the first position to the second position after the primary opening seat has engaged the opening plug.

11. The method of claim 10, further comprising uncovering the port by supplying pressure sufficient to cause the secondary opening seat to move from the first position to the second position after the secondary opening seat has engaged the primary opening seat.

12. The method of claim 11, further comprising setting the packer element by supplying pressure sufficient to compress the packer element.

13. The method of claim 12, further comprising supplying pressure sufficient to burst a rupture disk covering the opening and flowing fluid through the opening.

14. The method of claim 13, wherein placing the closing plug into the packer comprises dropping the closing plug and supplying pressure sufficient to cause the closing plug to land on the closing seat.

15. The method of claim 14, further comprising covering the opening by supplying pressure sufficient to cause the closing seat to move from the first position to the second position after the closing seat has engaged the closing plug.

16. The method of claim 15, further comprising drilling through the opening plug and the closing plug.

17. A method comprising:

providing a packer comprising:

a mandrel, a primary opening seat attached to an interior of the mandrel, a secondary opening seat attached to the interior of the mandrel, a landing seat attached to the interior of the mandrel, a packer element attached to an exterior of the mandrel, and a closing seat attached to the interior of the mandrel, wherein the secondary opening seat is between the primary opening seat and the landing seat, wherein the primary opening seat is between the closing seat and the secondary opening seat, wherein the primary opening seat is configured to engage an opening plug and move from a first position where the primary opening seat covers an opening to a second position where the primary opening seat does not cover the opening, wherein the secondary opening seat is configured to engage the primary opening seat and move from a first position where the secondary opening seat covers a port to a second position where the secondary opening seat does not cover the port, wherein the landing seat is configured to engage the secondary opening seat and provide a seal, wherein the packer element is configured to set when the port is not covered and the seal is provided, and wherein the closing seat is configured to engage a closing plug and move from a first position where the closing seat does not cover the opening to a second position;

providing the opening plug;

placing the packer in a wellbore;

placing the opening plug into the wellbore;

providing sufficient pressure to land the opening plug on the primary opening seat and move the primary opening seat from the first position to the second position thereby uncovering the opening, land the primary opening seat on the secondary opening seat and move the secondary opening seat from the first position to the second position thereby uncovering the port, and set the packer element.

18. The method of claim 17, further comprising providing sufficient pressure to burst a rupture disk covering the opening, and flowing fluid from the interior of the mandrel through the opening to the exterior of the mandrel.

19. The method of claim 18, further comprising:

providing the closing plug;

placing the closing plug into the wellbore; and providing sufficient pressure to land the closing plug on the closing seat and move the closing seat from the first position to the second position thereby covering the opening;

wherein the steps are performed in the order recited.

20. The method of claim 19, further comprising drilling through the opening plug and the closing plug.

* * * * *